US006718991B1

(12) United States Patent
Breyer et al.

(10) Patent No.: US 6,718,991 B1
(45) **Date of Patent: *Apr. 13, 2004**

(54) PROCESS AND AN ARRANGEMENT FOR MACHINE DISHWASHING

(75) Inventors: Jacques Breyer, Heusden (BE); Guenter Hellmann, Hilden (DE); Dieter Hemm, Hilden (DE); Klaus Wilbert, Duesseldorf (DE)

(73) Assignee: Ecolab GmbH & Co. oHG, Dusseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/553,570

(22) PCT Filed: May 25, 1994

(86) PCT No.: PCT/EP94/01698

§ 371 (c)(1),
(2), (4) Date: Jan. 26, 1996

(87) PCT Pub. No.: WO94/27488

PCT Pub. Date: Dec. 8, 1994

(30) Foreign Application Priority Data

| | | |
|---|---|---|
| May 25, 1993 | (DE) | 43 17 295 |
| Jul. 17, 1993 | (DE) | 43 24 106 |
| Jul. 19, 1993 | (DE) | 43 24 202 |

(51) Int. Cl.[7] ..... B08B 9/20; B08B 3/08; B08B 7/04

(52) U.S. Cl. ..... 134/25.2; 134/56 D

(58) Field of Search ..... 134/25.1, 25.2, 134/18, 22.13, 22.14, 56 D–58 D, 99.2

(56) References Cited

U.S. PATENT DOCUMENTS

| | | | | |
|---|---|---|---|---|
| 3,319,637 A | | 5/1967 | Gore et al. | 134/57 |
| 3,490,467 A | | 1/1970 | Gore et al. | 134/18 |
| 3,896,827 A | | 7/1975 | Robinson | 134/10 |
| 4,243,543 A | * | 1/1981 | Guilbert et al. | |
| 4,692,260 A | | 9/1987 | Sung | 252/99 |
| 4,799,855 A | * | 1/1989 | Milocco et al. | |
| 4,810,414 A | * | 3/1989 | Huge-Jensen et al. | 510/320 |
| 5,112,518 A | * | 5/1992 | Klugkist et al. | 510/226 |
| 5,173,207 A | * | 12/1992 | Drapier et al. | 510/226 |
| 5,308,530 A | * | 5/1994 | Aronson et al. | 510/393 |
| 5,474,699 A | * | 12/1995 | Ahmed et al. | 510/226 |
| 5,527,484 A | * | 6/1996 | Ahmed et al. | 510/226 |
| 5,551,990 A | * | 9/1996 | Dijk | 134/25.2 |

FOREIGN PATENT DOCUMENTS

| | | |
|---|---|---|
| DE | 1285087 | 12/1968 |
| DE | 1728093 | 3/1972 |
| DE | 2727463 | 1/1978 |
| DE | 3920728 | 1/1991 |
| DE | 4110764 | 10/1992 |
| EP | 0256679 | 7/1987 |
| EP | 0271155 | 12/1987 |
| EP | 0518721 | 12/1992 |
| JP | 40040893 | 2/1992 |

OTHER PUBLICATIONS

Fette, Seifen, Anstricmittel, 73 (1971), No. 7, p. 464, left-hand column, third–to–last paragraph.

Artikel "Enzyme in Spuelmitteln fuer Haushalts–Geschirrspuelmaschinen".

* cited by examiner

*Primary Examiner*—Alexander Markoff
(74) *Attorney, Agent, or Firm*—Merchant & Gould P.C.

(57) ABSTRACT

The process of dishwashing in an institutional dishwashing machine by adding to the wash liquor of the dishwashing machine a low-alkali content detergent composition and adding to a washing tank of the dishwashing machine a detergency booster composition containing an enzyme. Apparatus to practice the process is also disclosed.

18 Claims, 5 Drawing Sheets

PROCESS AND AN ARRANGEMENT FOR MACHINE DISHWASHING

BACKGROUND OF THE INVENTION

1. Field of the Invention

This invention relates to a process for machine dishwashing in institutional dishwashing machines in which a detergent and another active substance supporting the detergent in its effect are added to the wash liquor of the dishwashing machine. The invention also relates to an arrangement for carrying out the process which comprises a detergent feed system and a feed system for another active substance with an associated pump and pump control system.

An institutional dishwashing machine normally contains several tanks arranged in tandem from which wash liquor is sprayed against the crockery passing through the dishwashing machine. The tanks are arranged in the form of a cascade, the wash liquor passing successively through the tanks from the crockery exit or outlet end to the crockery entrance or inlet end, so that the degree of soiling of the wash liquor increases from the outlet end to the inlet end. Fresh water is introduced into the dishwashing machines at the outlet end. The quantity of detergent required is introduced into at least one washing tank also known as the feed tank. The detergent is normally added automatically in dependence upon the conductivity or the pH value of the wash liquor or, where liquid detergent or powder-form detergent already dissolved in water is added, even by means of a timed feed pump.

In normal machine dishwashing, starch deposits which build up on the crockery often cannot be prevented and existing starch deposits cannot be removed with the detergents used in practice in the usual in-use concentrations. Accordingly, crockery affected by starch deposits is subjected to so-called thorough cleaning at certain time intervals. In the thorough cleaning process, a distinctly above-average concentration of detergent is established in the wash liquor. Another alternative is to spray a highly concentrated alkaline detergent onto the crockery in the course of a routine dishwashing cycle. In addition, manual tank cleaning is also possible 2. Discussion of Related Art It is known from DE-OS 17 28 093, which relates to dishwashing in domestic dishwashing machines, that a rinse aid may be added together with amylase to the rinsing water in order to remove starch deposits on the crockery. If desired, protease or lipase may be added to the rinse aid in addition to the amylase.

In addition, DE-AS 12 85 087 describes a machine dishwashing process in which an alkaline detergent is added to the dishwashing machine in the main wash cycle while an enzyme-containing, more particularly amylase-containing, rinse aid is introduced in the final rinse cycle and optionally in the prewash cycle. The object of this is to degrade starch formed on the crockery in the final-rinse cycle and optionally in the prewash cycle. However, it is specifically pointed out that the enzyme-containing rinse aid cannot be added in the main wash cycle because the alkalinity of the detergent would immediately destroy the ferments.

3. Description of the Invention

In the Journal Fette, Seifen, Anstrichmittel, 73 (1971), No. 7, page 464, left-hand column, third-to-last paragraph, it is summarily pointed out that enzyme-containing detergents cannot be used in institutional dishwashing machines on account of the long contact times required. In view of the brief contact time in which the crockery comes into contact with the wash liquor in institutional dishwashing machines, it would not appear possible to the expert that starch deposits on crockery can be prevented or degraded with enzyme-containing detergents in institutional dishwashing machines.

A corresponding process and an arrangement for carrying out this process are known from DE-A-39 20 728. In this known machine dishwashing process for institutional dishwashing machines, active oxygen is introduced into the feed or washing tank of the dishwashing machine in addition to the detergent as the other active substance supporting the detergent in its effect. To maintain the concentration of oxygen in the washing tank in the event of interruptions in the wash cycle, more active oxygen is introduced into the washing tank during the interruptions.

The object of the present invention was to provide a solution which would permanently suppress the formation of starch deposits on the crockery during machine dishwashing in institutional dishwashing machines.

In a process of the type mentioned at the beginning, the solution provided by the invention is characterized in that a low-alkali detergent, more particularly based on phosphate or nitrilotriacetic acid or salts thereof (NTA), is added as the detergent while a detergency booster containing an enzyme, preferably a carbohydrate-degrading enzyme, more particularly an amylase-containing detergency booster, is added as the additional active substance.

In an arrangement of the type mentioned at the beginning for carrying out the process, the solution provided by the invention is characterized by a feed system for an enzyme-containing detergency booster which is separate from the detergent feed system and which comprises an operational regime for maintenance feeding during interruptions in or stoppage phases of the operation of the dishwashing machine and/or feed intervals of the detergent feed system and/or an operational regime for surge feeding after interruptions in or stoppage phases of the operation of the dishwashing machine and/or feed intervals of the detergent feed system.

It has surprisingly been found that a low-alkali detergent in typical concentrations in conjunction with an enzyme-containing detergency booster leads to excellent removal of and inhibition of starch deposits on crockery, even over the brief contact times of 10 to 180 seconds typical of institutional dishwashing machines. Compared with known dishwashing processes which use a highly alkaline detergent or a highly concentrated alkaline wash liquor, the process according to the invention is distinguished by a considerable improvement in operational and applicational safety. There is no longer any risk of injury to operating personnel by highly alkaline detergent or wash liquor.

The enzyme-containing detergency booster may be introduced—in the same way as typical detergents—either into at least one feed or washing tank of the dishwashing machine or even into the liquid flowing through the final rinse pipe and/or the spray system of the institutional dishwashing machine and added in this way to the dishwashing machine. The detergency booster may contain as enzyme amylase, lipase, protease or other enzymes, more particularly carbohydrate-degrading enzymes, either individually or in the form of suitable mixtures. If desired, the low-alkali detergent may optionally contain other complexing agents than those mentioned.

In one embodiment of the invention, a concentration of 0.5 to 15 g/l of low-alkali detergent and a concentration of 0.05 to 2 g/l of detergency booster may be established in the wash liquor.

In another advantageous embodiment of the invention, a low-alkali detergent is introduced in the in-use concentration with a pH value of 7 to 11 and preferably in the range from 9.1 to 10.8.

In another particularly advantageous embodiment, the detergency booster introduced contains around 0.01 to 0.6% by weight and preferably 0.45 to 0.55% by weight of enzyme, particularly amylase, and 10 to 25% by weight and preferably 15 to 20% by weight of propylene glycol, more particularly 1,2-propylene glycol, and a corresponding quantity of water.

In another embodiment of the invention, the enzyme-containing detergency booster is added to the wash liquor at the same time as or after the low-alkali detergent during regular operation of the dishwashing machine at typical detergent concentrations of 0.5 to 8 g/l in the wash liquor and/or during periodic thorough cleaning at an increased concentration of detergent in the wash liquor of 3 to 15 g/l.

It is known that enzymes, such as amylase, lipase or protease, are not stable in the wash liquor of institutional dishwashing machines. After they have been introduced into the washing tank of an institutional dishwashing machine, enzyme-containing detergents or detergency boosters lose their effect relatively quickly. In the event of interruptions in or stoppage phases of the operation of the dishwashing machine and/or intervals in the feed of the detergent or detergency booster, enzyme degradation or enzyme decomposition (consumption) occurs to such an extent that the enzyme content of the wash liquor often falls at a rate of around 40 to 60% per hour. Depending on the degree of consumption, however, the enzyme content may fall to far more than half, for example even after an interruption of only 30 minutes in the operation of the machine. In order to ensure that a sufficient concentration of enzyme to obtain a satisfactory cleaning result is present in the wash liquor after an interruption in or stoppage phase of the operation of the dishwashing machine and/or an interval in the feed of the detergent or detergency booster, another embodiment of the invention is characterized in that, in the event of interruptions in or stoppage phases of the operation of the dishwashing machine and/or intervals in the feed of the detergent, the enzyme-containing detergency booster undergoing the enzyme degradation or enzyme decomposition (consumption) under the washing conditions prevailing in an institutional dishwashing machine is added to the wash liquor in a quantity which equalizes the degradation or decomposition (consumption) of enzyme during the particular interruption or stoppage phase and/or feed interval so that, after the particular interruption or stoppage phase and/or feed interval, the operation of the dishwashing machine is continued with substantially the same concentration of enzyme in the wash liquor as was present before the particular interruption or stoppage phase and/or feed interval. This ensures that a sufficiently high concentration of enzyme to obtain the required cleaning result (preventing the buildup or removal of starch deposits on the crockery) is present in the wash liquor during each active cleaning phase of the wash cycle in an institutional dishwashing machine.

Enzyme may already be incorporated in the liquid or powder-form low-alkali detergent. More particularly, a solid enzyme carrier, for example an amylase carrier, may be incorporated in a powder-form low-alkali detergent. This enzyme-containing detergent is then used in combination with the enzyme-containing detergency booster. For this particular case, another embodiment of the invention is characterized in that a low-alkali detergent, more particularly a powder-form low-alkali detergent, containing sufficient quantities of an enzyme for immediate washing is introduced into the wash liquor during detergent feed periods and in that the enzyme-containing detergency booster is introduced into the wash liquor immediately after or during the interruptions or stoppage phases and/or the detergent feed intervals to maintain the concentration of enzyme, i.e. to equalize the degradation or decomposition (consumption) of enzyme. In this case, therefore, the enzyme-containing detergency booster is only introduced into the wash liquor during or immediately after the detergent feed intervals and/or the interruptions in or stoppage phases of the operation of the dishwashing machine. There is no introduction of the enzyme-containing detergency booster during those periods of the active wash cycle in which the detergent is introduced into the washing tank of the dishwashing machine.

However, it is also possible to use an enzyme-free, liquid or powder-form low-alkali detergent in combination with an enzyme-containing detergency booster. For this particular case, another embodiment of the invention is characterized in that an enzyme-free, more particularly liquid, low-alkali detergent and at the same time—commensurate with the consumption of detergent—the enzyme-containing detergency booster are introduced into the wash liquor during detergent feed times and in that, immediately after or during the interruptions or stoppage phases and/or the detergent feed intervals, the enzyme-containing detergency booster is introduced into the wash liquor to maintain the enzyme concentration, i.e. to equalize the degradation or decomposition (consumption) of enzyme. In cases where an enzyme-free detergent is used in combination with an enzyme-containing detergency booster (in contrast to the above-described case where an enzyme-containing detergent is combined with an enzyme-containing detergency booster), enzyme-containing detergency booster is introduced into the at least one feed or washing tank of the institutional dishwashing machine at the same time as the detergent, even during the feed of detergent or the detergent feed times.

According to the invention, there are two alternatives for the introduction or subsequent feeding of the enzyme-containing detergency booster. On the one hand, the enzyme-containing detergency booster may be introduced or subsequently added during the interruptions in or stoppage phases of the operation of the dishwashing machine and/or the detergent feed intervals; on the other hand, the enzyme-containing detergency booster may be introduced or subsequently added immediately after the interruptions in or stoppage phases of the operation of the dishwashing machine and/or the detergent feed intervals.

In the first alternative, the concentration of enzyme in the wash liquor during the particular interruption or stoppage phase and/or the detergent feed intervals is maintained by maintenance feeding of the enzyme-containing detergency booster. In one advantageous embodiment of the invention, the maintenance feeding takes place in individual feed strokes.

In this first alternative, therefore, the invention is concerned primarily with maintenance feeding of the enzyme-containing detergency booster during the stoppage phases of the dishwashing machine between two successive wash phases or during the intervals between two detergent feed times. The effect of maintenance feeding is that new enzyme-containing detergency booster enters the at least one feed or washing tank commensurately with the degradation or decomposition (consumption) of enzyme. Accordingly, the washing tank or rather the wash liquor of the dishwashing machine is always kept in readiness for a new wash phase. Wash liquor containing sufficient enzymes or a sufficiently high enzyme concentration is immediately available at the beginning of each wash phase. Where detergent, more particularly powder-form detergent, containing a sufficient quantity of enzyme for immediate washing is used, the enzyme-containing detergency booster is only introduced into the at least one washing tank during the stoppage phases or detergent feed intervals commensurately with the degradation of enzyme. Where an enzyme-free detergent, more particularly a liquid detergent, is used, the enzyme-containing detergency booster is introduced in addition to maintenance feeding during the detergent feed times. Accordingly, where the enzyme-free detergent is used, enzyme is introduced into the washing tank or into the wash liquor during the wash phases commensurately with the consumption of detergent while enzyme-containing detergency booster is introduced into the washing tank or into the wash liquor during the stoppage phases or the detergent feed intervals commensurately with the degradation or decomposition of enzyme. Parallel feeding provides for the use of enzyme-containing detergency booster, for example amylase solution, which cannot be formulated with the usual enzyme-free alkaline detergents, more particularly low-alkali detergents. Liquid or powder-form detergent is introduced during the rinse phases as a function of the measured conductivity or the measured pH value or on a timed basis only during certain feed times. If the corresponding intervals or rather detergent feed intervals become so long that enzyme is degraded in a quantity detrimental to the performance of the next rinse phase, it is possible in accordance with the invention subsequently to introduce enzyme-containing detergency booster, again in the form of maintenance feeding, commensurately with the degradation of enzyme during intervals in the parallel feeding regime occurring in the wash phase.

In another embodiment of the invention relating to the maintenance feeding regime, the enzyme input rate of the maintenance feeding regime is optimized on the basis of enzyme activity determination. Once the decomposition rate of the enzymes is known, it may be sufficient to add enzyme-containing detergency booster at certain time intervals. In this connection, another embodiment of the invention is characterized in that maintenance feeding of the enzyme-containing detergency booster is commenced after the enzyme content of the wash liquor has fallen by around 20%.

In another embodiment of the invention, the other of the two alternatives mentioned above is characterized in that the particular interruption or stoppage phase and/or feed interval is immediately followed by surge feeding in which enzyme-containing detergency booster is added to the wash liquor in a quantity corresponding to the degradation or decomposition (consumption) of enzyme which has taken place during the particular interruption or stoppage phase and/or feed interval. In this embodiment, therefore, the interruption in or stoppage phase of the operation of the dishwashing machine and/or the detergent feed interval is followed by surge feeding of the enzyme-containing detergency booster, the quantity of enzyme-containing detergency booster added during surge feeding being adapted to the duration of the interruption and gauged in such a way that it corresponds to the degradation or decomposition (consumption) of enzyme which has taken place during the interruption. Accordingly, no enzyme-containing detergency booster is added to the at least one feed or washing tank or to the wash liquor of the dishwashing machine during the interruption in or stoppage phase of the operation of the machine and/or the detergent feed interval. The feed of enzyme-containing detergency booster only takes place after the particular interruption or interval over a relatively short period so that the quantity of enzyme which has been consumed during the particular interruption or feed interval is replaced. The quantity of detergency booster added during surge feeding is gauged as a function of the duration of the interruption and/or feed interval and as a function of the trend of the enzyme decomposition process which can be described by a mathematical function, for example an e-function. This ensures that the enzyme consumed is replaced fairly accurately without any significant underdosage or overdosage.

In another preferred embodiment of the present invention, exact feeding geared to demand is achieved by taking into account the fact that the consumption of enzyme as a function of time essentially follows an exponential function, the concentration decreasing exponentially from a starting concentration. Accordingly, satisfactory surge feeding after an interval t must follow the complementary function of the course of the enzyme consumption process.

As in the maintenance feeding regime, it is possible in the surge feeding regime to add the enzyme-containing detergency booster at the same time as the detergent during the detergent feed times in cases where an enzyme-free detergent is used.

The arrangement according to the invention for carrying out the process according to the invention is basically characterized by a feed system for the enzyme-containing detergency booster which is separate from the detergent feed system and which comprises an operational regime for maintenance feeding and/or an operational regime for surge feeding. The detergent feed system may be designed in the usual way, for example as a feed pump in the case of a liquid detergent or as a freshwater or liquor dispensing system in the case of a powder detergent. According to the invention, therefore, the only addition is essentially the feed system for the enzyme-containing detergency booster which is separate or separated from the detergent feed system. The feed system for the enzyme-containing detergency booster has either an operational regime for maintenance feeding or an operational regime for surge feeding and is provided with the technical means required for the particular operational regime. However, besides this embodiment where the feed system for the detergency booster only has either technical means for the maintenance feeding regime or technical means for the surge feeding regime, the feed system for the detergency booster may also be provided with technical means for both regimes so that the particular operational regime required can be freely selected by the machine operator. Accordingly, this arrangement provides for maintenance feeding during the interruptions in or stoppage phases of the operation of the dishwashing machine and/or the detergent feed intervals or for surge feeding immediately after interruptions in or stoppage phases of the operation of the dishwashing machine and/or detergent feed intervals, so that any reduction in enzyme activity occurring during that time through the degradation or decomposition of enzyme is compensated. Such subsequent or extra feeds are necessary in cases where the supply of detergent to the institutional dishwashing machine is regulated by a control system which does not take the enzyme content of the wash liquor into consideration. In contrast to the enzyme content, the concentration of detergent in the wash liquor remains substantially constant during interruptions or stoppage phases of the dishwashing machine. Without the subsequent introduction of enzyme, it would otherwise only be detergent that would normally be introduced into the at least one feed or washing tank or into the wash liquor of the dishwashing machine commensurate with the supply of fresh water at the beginning of a new wash cycle. This would result in a deficient enzyme content and hence in an unsatisfactory cleaning result, at least in regard to starch deposits. This problem is overcome by the arrangement according to the invention.

In one embodiment of the arrangement for carrying out the surge feeding regime, the arrangement comprises a counter to which interval pulses are regularly delivered during the interruptions. These interval pulses do not increase the count linearly, but instead in a step-by-step function complementary to the decomposition of enzyme, more particularly an e-function. Finally, the count asymptotically approaches a predetermined end value at a minimum counting rate. After the interruption or stoppage phase and restarting of the machine, the counter is counted linearly downwards at a constant rate from the count reached until the count reaches zero. During the downward counting process, the downward counting pulses activate a pump which triggers the surge feeding regime. Accordingly, the duration of the surge feeding regime is determined by the count reached during the interruption. The duration of the surge feeding regime is shorter by orders of magnitude than the duration of the interruptions in question. Accordingly, in a matter of seconds to minutes, the surge feeding regime compensates the consumption of active substance over several tens of minutes to hours. Accordingly, the count is a measure of the duration of the surge feeding regime. This duration is always far shorter than the duration of intervals, so that the surge feeding of the enzyme-containing detergency booster takes place at a far higher rate than the degradation or decomposition (consumption) of the enzyme in the wash liquor. In this way, the consumption of enzyme over several tens of minutes is compensated after only a very short time of a few minutes. This form of surge feeding takes place not only immediately after interruptions in or stoppage phases of the operation of the dishwashing machine, but if desired even immediately after detergent feed intervals.

In the context of the invention, the term "counter" is meant to be interpreted in its broadest sense. It encompasses any counting device which counts the interval pulses delivered to it in accordance with a predetermined function and, hence, also provides for non-linear counting processes, for example those following an e-function. The variation in the time interval between the pulses may be used to accelerate (compress) or delay (extend) the counting process in terms of time. The interval pulses may be separated by constant time intervals and may be multiplied by a factor corresponding to an e-function in terms of time. On the other hand, the interval pulses may also be delivered to the counter with different time intervals. Finally, the counter may also incorporate an adding stage which, with each interval pulse, increases the count by an amount varying as a function of time.

In another embodiment of the invention which is applicable both to arrangements with the maintenace feeding regime and to arrangements with the surge feeding regime, the feed system for the enzyme-containing detergency booster has an additional operational regime for parallel feeding which operates in parallel with the detergent feed system when the detergent feed system is switched on. In this embodiment, both enzyme-containing and enzyme-free detergent can be used in the arrangement, the parallel feeding regime providing for the introduction of enzyme-containing detergency booster where an enzyme-free detergent is used. The parallel feeding regime and the maintenance feeding regime or the surge feeding regime essentially differ only in the amount of enzyme-containing detergency booster which is delivered to the feed tank or to the wash liquor per unit of time.

In another advantageous embodiment of the invention, a frequency-controlled flow inducer or a diaphragm pump is used to deliver the enzyme-containing detergency booster. A pump of this type may be operated with a number of strokes per unit of time corresponding to the decomposition of enzyme. Accordingly, relatively few pump strokes are sufficient for the maintenance feeding regime whereas a far greater number of pump strokes is required for the surge feeding regime and/or for the parallel feeding regime, if any, where an enzyme-free detergent is used. Accordingly, it has proved to be useful in practice if the associated frequency control system of the pump has a first control range for the maintenance feeding regime and a second control range—with a far greater output by comparison with the first control range—for the wash phase of the dishwashing machine when the detergent feed system is switched on.

BRIEF DISCUSSION OF THE DRAWINGS

The invention is described by way of example in the following with reference to the accompanying drawings, wherein.

DETAILED DESCRIPTION OF THE DRAWINGS

Figure 1:
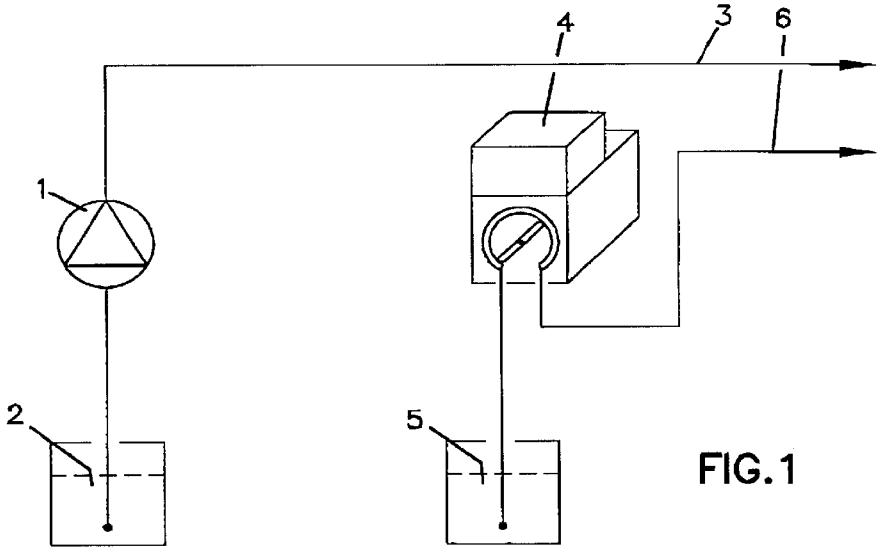
FIG. 1 is a block circuit diagram of a detergent feed system and booster feed system for liquid enzyme-free detergent and for liquid enzyme-containing booster.
Figure 5:
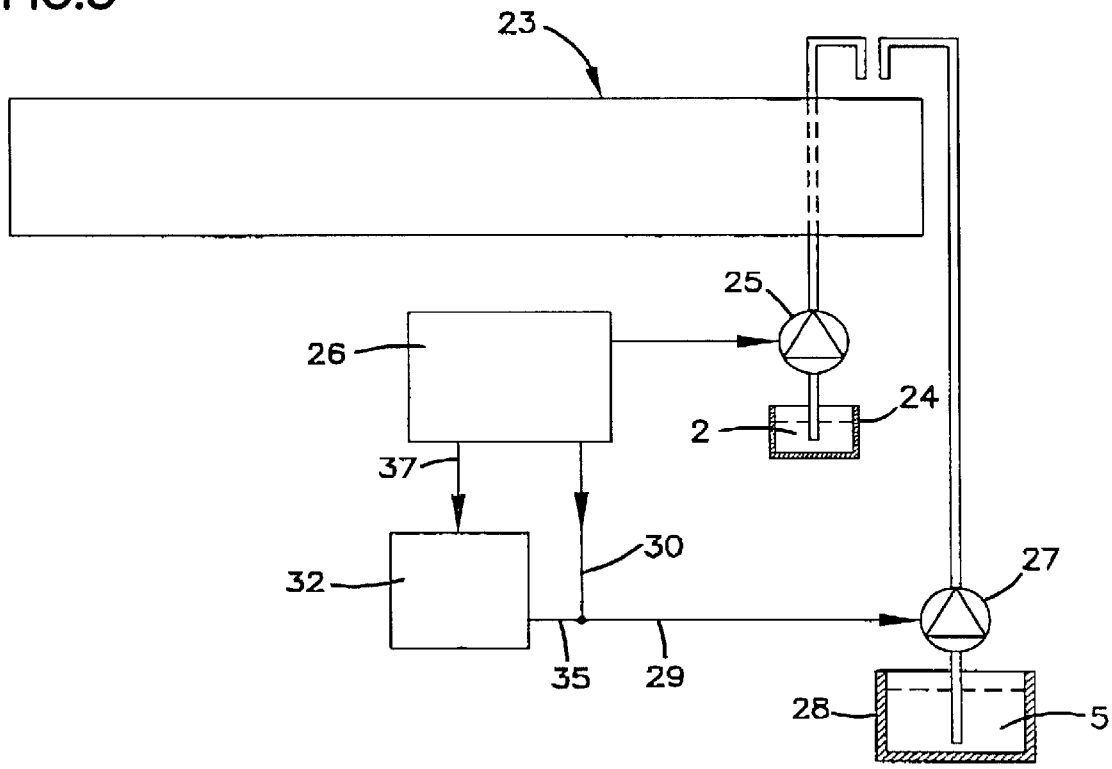
FIG. 5 is a block circuit diagram of a surge feeding arrangement.

FIG. 1 shows the detergent feed system for liquid, enzyme-free, low-alkali detergent 2 associated with an institutional dishwashing machine of the type illustrated by way of example in FIG. 5 and the booster feed system for liquid, enzyme-containing booster 5 associated with the institutional dishwashing machine. A standard feed pump 1 for liquid detergent delivers liquid enzyme-free detergent 2 from a liquid detergent tank, for example under the control of a conductivity or pH measurement, through a pipe 3 to at least one feed or washing tank (not shown) of a dishwashing machine. Provided parallel to the liquid detergent feed pump 1 is a frequency-controlled flow inducer 4 which also delivers from a tank containing liquid enzyme-containing booster 5 to the above-mentioned, at least one feed or washing tank through a pipe 6. This feed system for liquid enzyme-containing booster 5 is controllable by internal and/or external electronic circuitry in such a way that a function diagram of the type illustrated, in FIG. 2 is obtained, i.e. maintenance feeding 17, 18 and, optionally, parallel feeding 16 of the booster 5 is possible in addition to feed of the detergent.

Figure 2:
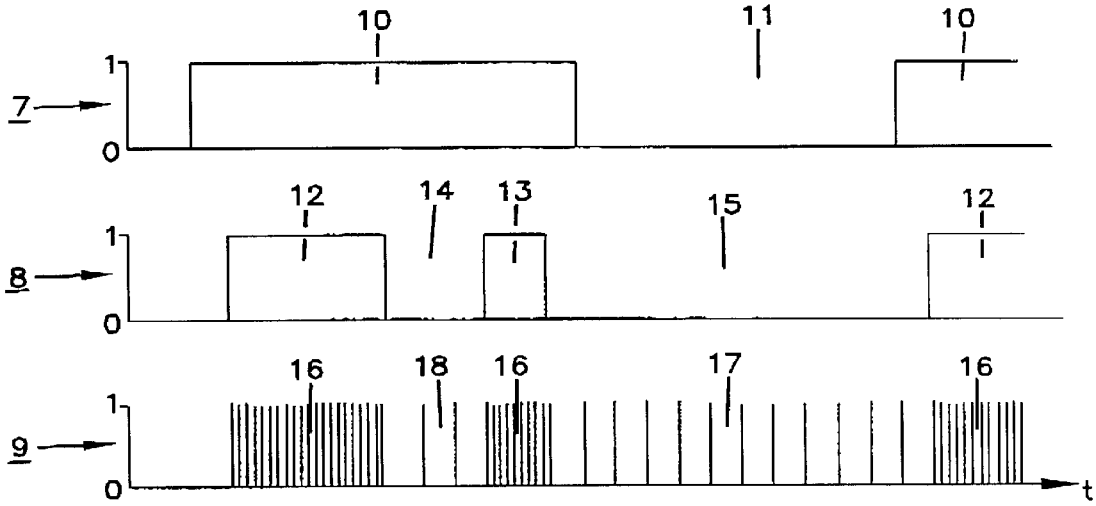
FIG. 2 is a function diagram for parallel and maintenance feeding of enzyme-containing booster where enzyme-free detergent is used.

FIG. 2 shows various on and off switching states (1/0) as a function of time t in three lines 7, 8 and 9. The operational regime of the institutional dishwashing machine is symbolized in the uppermost line denoted by the reference 7. The wash phases or switch-on states are denoted by the reference 10 while the interruptions or stoppage phases are denoted by the reference 11. The feed of the enzyme-free detergent 2, i.e. the active operational regime of the liquid detergent feed pump 1, is symbolized in the second line denoted by the reference 8. In this example of embodiment, the feed pump 1 is assumed to be activated twice during one switch-on state 10 of the machine as a function of the conductivity or the pH value of the wash liquor in the dishwashing machine as measured in at least one washing tank thereof. The corresponding two detergent feed times are denoted by the references 12 and 13. A feed interval between these two feed times is denoted by the reference 14 while the feed interval corresponding to the interruption in or stoppage phase 11 of the operation of the dishwashing machine is denoted by the reference 15. The feed of the enzyme-containing detergency booster 5, i.e. the active operational regime of the flow inducer 4, is symbolized in the third line denoted by the reference 9.

As shown in FIG. 2, parallel feeding 16 of the booster 5 takes place through a rapid sequence of individual pump strokes of the flow inducer 4 during the detergent feed times 12, 13 of the detergent feed pump 1. Each individual pump stroke is shown as an individual vertical line in line 9 of FIG. 2 and in line 9*a* of FIG. 4. By contrast, the work of the flow inducer 4 during the feed intervals 14, 15 of the dishwashing machine is very much slower. In the corresponding maintenance feeds 17, 18, considerably fewer pump strokes are completed per unit of time than during parallel feeding 16 in the wash phases 10 or rather the detergent feed times 12, 13. It can be seen that the liquid detergent 2 is not added during the interruption in or stoppage phase 11 of the dishwashing machine (detergent feed interval 15). There is no need for any such feed because there is no significant reduction in the concentration of detergent in the wash liquor. Only the degradation or decomposition (consumption) of enzyme during the stoppage phase 11 is compensated by the slower subsequent feeding or maintenance feeding 17 over that period. It can be favorable to provide for individual pump strokes of a maintenance feeding 18 during prolonged feed intervals 14 in the wash phases 10 of the dishwashing machine in order to compensate for the degradation or decomposition (consumption) of enzyme continually occurring over this period also.

Figure 3:
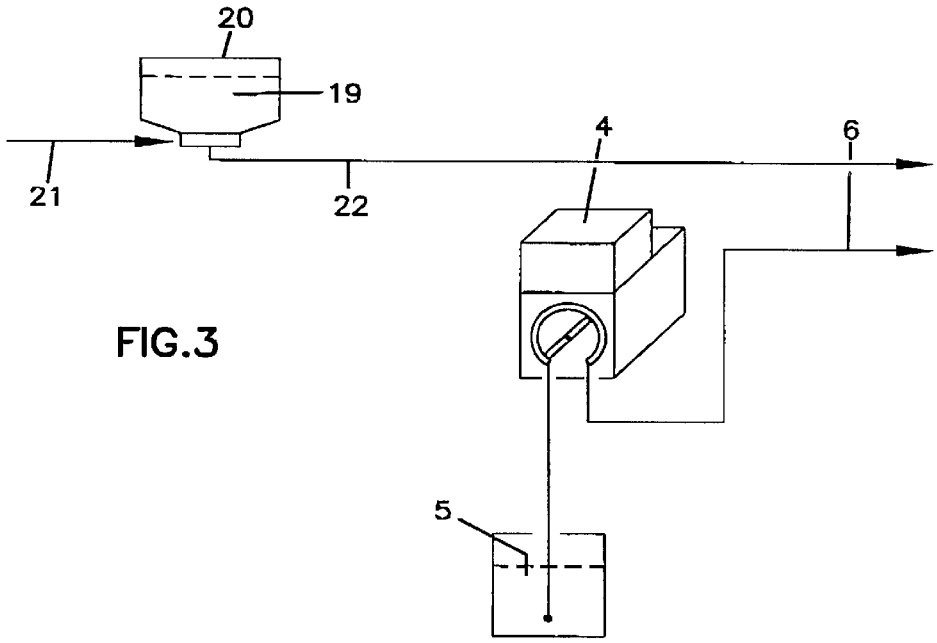
FIG. 3 is a block circuit diagram of a detergent feed system and booster feed system for an enzyme-containing powder detergent and a liquid enzyme-containing booster.
Figure 4:
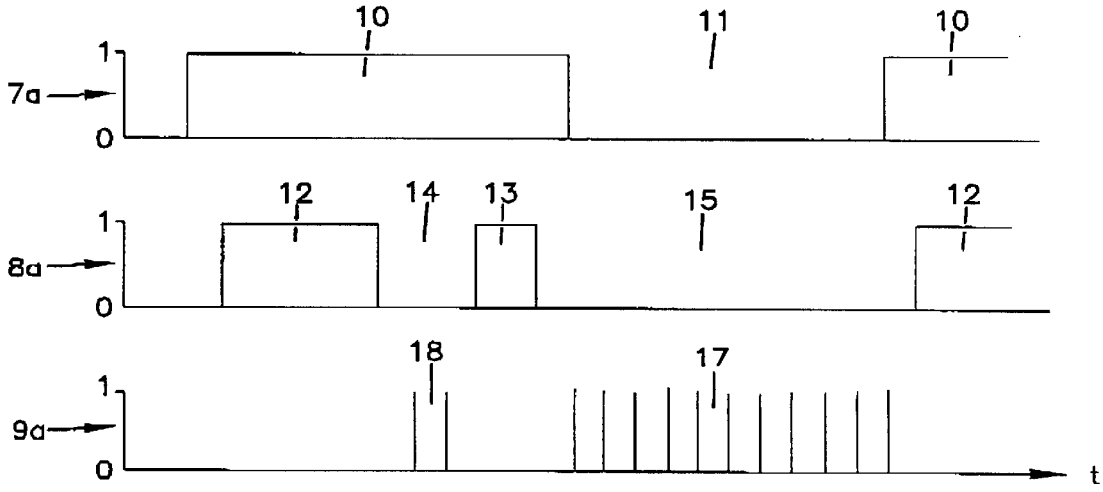
FIG. 4 is a function diagram for the maintenance feeding of enzyme-containing booster where enzyme-containing detergent is used.

If a machine dishwashing detergent 19 already contains enzymes, which is possible above all in the case of powder detergents, there is generally no need for the parallel feeding of enzyme-containing booster 5, maintenance feeding 17 being sufficient. FIGS. 3 and 4 show an example of embodiment for this case, FIG. 3 showing the detergent feed system for an enzyme-containing low-alkali powder detergent 19 associated with an institutional dishwashing machine and the separate feed system for the enzyme-containing liquid booster 5 while FIG. 4 shows the various on and off switching states (1/0) of the institutional dishwashing machine and the feed systems as a function of the time t in the three lines 7*a*, 8*a* and 9*a*. The detergent feed system shown in FIG. 3 consists of a hopper 20 filled with an enzyme-containing low-alkali powder detergent 19. As known from standard feed systems, the enzyme-containing powder detergent 19 is introduced into the hopper 20 through a freshwater or liquor dispensing system 21 and a pipe 22 leading to at least one feed or washing tank of an institutional dishwashing machine (arrowed direction).

In addition, the system for adding enzyme-containing booster 5 shown in FIG. 3 is provided with a frequency-controlled flow inducer 4 which also delivers the enzyme-containing detergency booster 5 from a tank through a line 6 to the at least one feed or washing tank of the dishwashing machine. In contrast to the case shown in FIGS. 1/2, however, the flow inducer 4 shown in FIGS. 3/4 only operates during the stoppage phase 11 of the dishwashing machine and, optionally, during the feed interval 14, as symbolized in line 9*a* of FIG. 4. Lines 7*a* and 8*a* show identical operational regimes to lines 7 and 8 for the embodiment shown in FIGS. 1/2. Since, in the embodiment shown in FIGS. 3 and 4, enzyme is introduced into the at least one feed or washing tank during the feed 12, 13 of enzyme-containing detergent 19 during the wash phases 10, there is no need in this embodiment for the parallel feed of enzyme-containing booster during the feed times 12 and 13. It is only during the interruption or stoppage phase 11 or the detergent feed interval 15 that the enzyme-containing booster 5 is added in the form of a maintenance dose 17. In addition, it can be of advantage in some cases to provide for one or more feed strokes as maintenance doses 18 in the intervals 14 between two feeds 12 and 13 of detergent, as in the embodiment illustrated in FIG. 2; this is also symbolized in line 9*a* of FIG. 4.

A modification of a frequency-controlled flow inducer 4, 27 is preferably used for the maintenance feeding 17, 18 and surge feeding SD explained hereinafter and the parallel feeding 16 optionally required, the pump used for maintenance feeding being denoted by the reference numeral 4 in FIGS. 1 and 3 and the pump used for surge feeding being denoted by the reference numeral 27 in FIG. 5. Two frequency control ranges are possible, namely a first range I for parallel feeding or surge feeding SD explained hereinafter with an output range of 8 to 290 ml/minute and a second range II for the maintenance feedings 17, 18 with an output range of 1.5 to 3.5 ml/min. These two control ranges can be externally selected so that post-adjustment is possible in accordance with the washing result. It is of course also possible for each form of feeding to provide a separate pump for the particular delivery range required or—in the case of surge feeding and parallel feeding—a single pump with one control range for both forms of feeding.

Instead of the maintenance feedings 17, 18 shown in line 9 of FIG. 2 in conjunction with the parallel feedings 16 or the maintenance feedings 17, 18 shown in line 9*a* of FIG. 4 without any parallel feeding, enzyme-containing booster 5 can also be added and re-added by surge feeding SD. In contrast to the maintenance feedings 17, 18, which take place during the interruption or stoppage phase 11 and/or the detergent feed intervals 14, 15, the surge feeding regime SD is activated immediately after an interruption or stoppage phase 11 and/or a detergent feed interval 14, 15. Of the function diagrams shown in FIGS. 2 and 4, the corresponding function diagrams for surge feeding SD would not differ in lines 7, 7*a* and 8, 8*a* and, in lines 9, 9*a*, would differ in the fact that the maintenance feedings 17, 18 would disappear and, instead, enzyme-containing booster 5 would be added to the at least one feed or washing tank of the dishwashing machine as a surge feed SD after the stoppage phase 11 and/or the detergent feed intervals 14,15 or at the beginning of the wash phases 10 or the detergent feed times 12, 13. Surge feeding is explained in more detail hereinafter with reference to FIGS. 5 to 7.

FIG. 5 shows an institutional dishwashing machine 23 through which the crockery to be washed passes from left (inlet end) to right (outlet end). The dishwashing machine 23 contains several tanks arranged in tandem from which wash liquor is sprayed against the crockery and then drains off again into the tanks. The tanks are arranged in known manner in the form of a cascade, the wash liquor passing through the tanks successively from the outlet end (right) to the inlet end (left), so that the degree of soiling of the wash liquor increases from the outlet end to the inlet end.

At the outlet end, water is introduced into the dishwashing machine 23. In addition, low-alkali detergent 2 accommodated in liquid form in the detergent feed tank 24 is introducd into the dishwashing machine 23 from the tank 24. The detergent 2 is delivered in metered form by a pump 25. The pump 25 is driven by a pump control unit 26. The detergent 2 is added as a function of the conductivity or pH value of the wash liquor contained in the dishwashing machine 23. The pump control unit 26 controls another pump 27 which pumps a liquid enzyme-containing detergency booster 5 into the dishwashing machine 23 from a tank 28. The booster contains enzymes, such as amylase, lipase or protease. The booster 5, which is accommodated in liquid form in the tank 28, is pumped by the pump 27, preferably a flow inducer, into the dishwashing machine 23. The pump 27 is controlled by pulses delivered to it through a control line 29. The pump is driven by a stepping motor, each pulse in the control line 29 corresponding to a certain delivery volume of the pump 27. The control line 29 is connected to an operating pulse line 30 coming from the pump control unit 26. The operating pulse line 30 supplies operating pulses during the operational regime 10 of the dishwashing machine 23, the frequency of these pulses being gauged in such a way that the pump 27 maintains a certain concentration of enzyme-containing booster 5 in the wash liquor, i.e. parallel feeding 16 is effected. In the event of an interruption in operation or a stoppage phase 11 of the dishwashing machine or feed intervals 14, 15, the pump control unit 26 does not deliver any pulses to the pump 25 for the detergent 2, nor does it supply any operating pulses to the operating pulse line 30. Accordingly, the situation thus prevailing is equivalent to the case of surge feeding (explained hereinafter) combined with parallel feeding 16 analogous to the example illustrated in FIG. 2.

A counter 32 is connected to an interval pulse line 31 of the pump control unit 26. In the event of an interruption in operation or a stoppage phase 11 of the dishwashing machine and/or during feed intervals 15 and, optionally, feed intervals 14, the interval pulse line 31 supplies pulses separated by a constant time interval to the counter 32.

Figure 6:
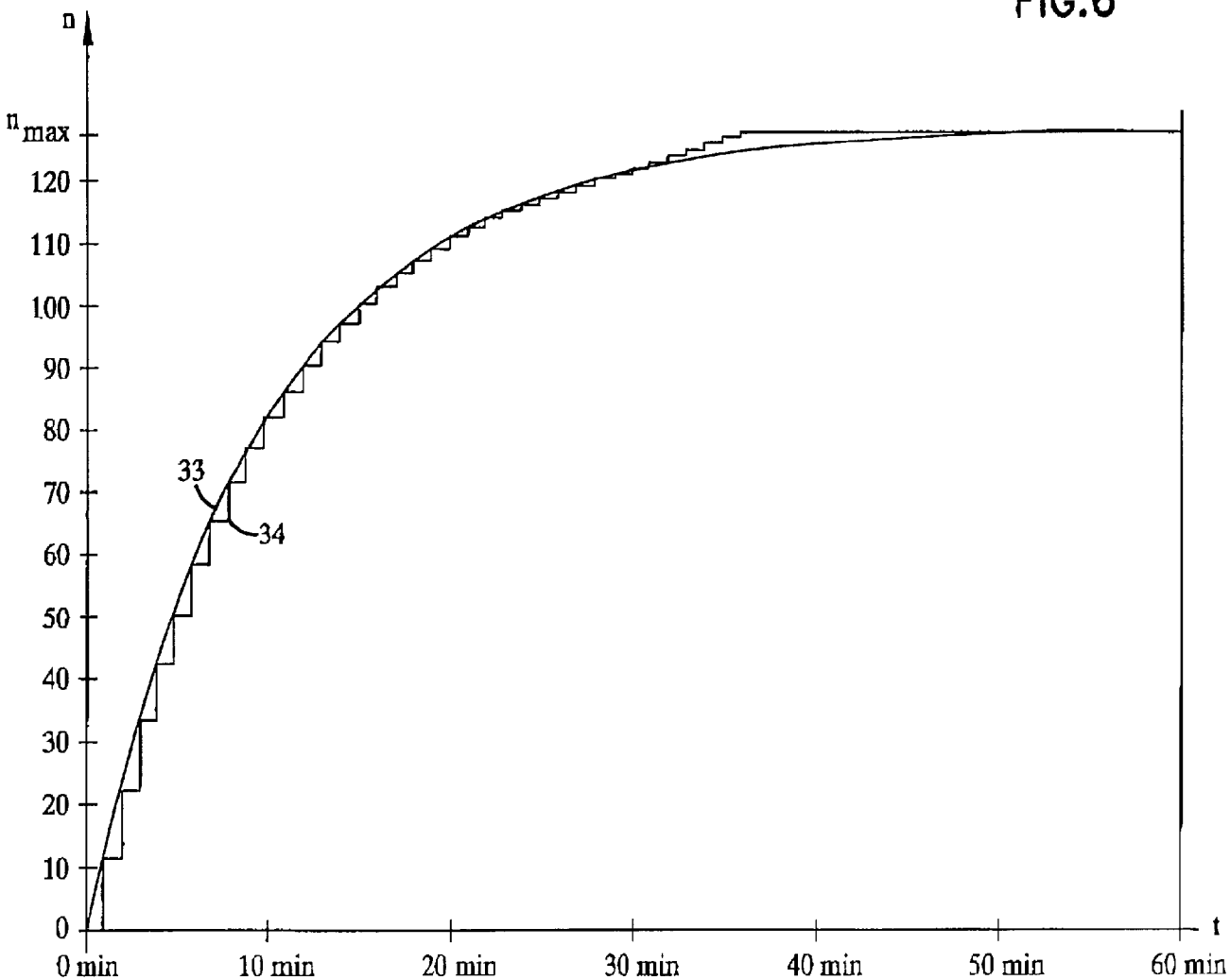
FIG. 6 is a diagram illustrating the theoretical feed function and the function approximated by a counting algorithm of the counter in the case of surge feeding.

The counter 32 counts non-linearly in the manner illustrated in FIG. 6. In FIG. 6, the stoppage time t during an interruption or stoppage phase 11 and/or an feed interval 14, 15 is plotted on the abscissa while the count n of the counter is plotted on the ordinate. In this embodiment, an interval pulse is supplied every minute. With each interval pulse, the count of the counter 32 is increased by a varying counting step. The size of the courting steps decreases with increasing duration of the time t. The counting capacity of the counter 32 in the case illustrated is 128. The trend which the count follows as a function of time corresponds to a stepped curve 33 which approximates an e-function 34.

In this embodiment of the invention, it is assumed that the trend which the degradation or decomposition (consumption) of the enzyme follows as a function of time during the stoppage time t corresponds substantially to the following exponential function (consumption function) $C_t=C_o*e^{\lambda t}$ where $C_t$ is the enzyme concentration at time t, $C_o$ is the starting concentration of the enzyme and $\lambda=1/\tau$, where $\tau$ is the consumption time constant.

The feed of enzyme-containing detergency booster 5 after a stoppage time t takes place in accordance with the function complementary to the consumption function $$V_t=V_{max}*(1-e^{-\lambda t})$$

where $V_t$ is the surge feeding time for a stoppage time of duration t and $V_{max}$ is the maximum surge feeding time. The ideal curve 34 of FIG. 6 approximated by the stepped curve 33 corresponds to the function $V_t$. In terms of circuitry, the stepped curve 33 is embodied in the counter 32 by means of a programmable logic unit (PLD). The non-linear counting function is achieved by varying the counting step width. The pulse rate of the interval pulses is adapted to the consumption function of the enzyme or the enzyme-containing detergency booster 5. The maximum count $n_{max}$ of the counter 32 is 128 which corresponds to a resolution of 7 bits.

After the stoppage or interval t, i.e. at the beginning of the operational phase 10 or at the beginning of the feed times 12 or optionally 13, the count of the counter 32 is counted linearly downwards to 0 in steps of 1. Pulses are produced at the counter output 35 and are delivered through the control line 29 to the pump 27. The pulses produced at the output 35 during the downward counting of the counter 32 actuate surge feeding by the pump 27. Surge feeding is terminated when the count reaches 0.

Figure 7:
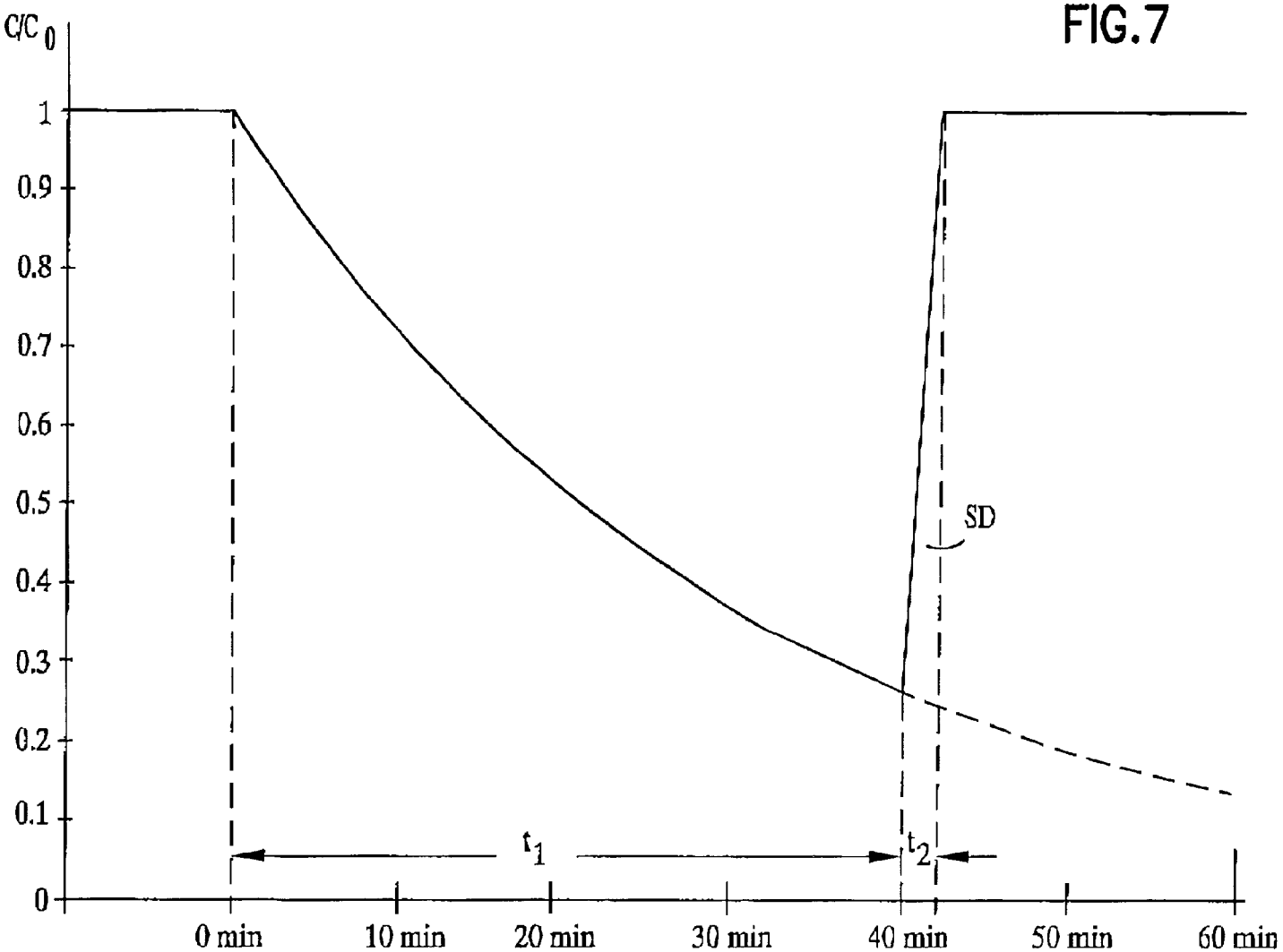
FIG. 7 shows the enzyme concentration in the wash liquor as a function of time during a break in operation and subsequent surge feeding.

FIG. 7 shows the trend which the concentration C of enzyme in the wash liquor follows as a function of time in the event of an interruption in or stoppage phase 11 of the operation of the dishwashing machine or a feed interval 14, 15 with a duration of $t_1$. The enzyme concentration $C/C_o$ standardized to the normal value $C_o$ is shown along the ordinate.

After the beginning of the stoppage time, the enzyme concentration falls exponentially from the value 1. The stoppage of duration $t_1$ ends with the beginning of the surge feeding time $t_2$. The operation of the dishwashing machine, i.e. the active operational regime 10 or the feed times 12, 13, recommences at the end of the period $t_1$ or the beginning of the period $t_2$, surge feeding SD taking place in the initial phase. During this surge feeding, the enzyme concentration undergoes a steep linear increase to the normal value of "1". Subsequent operation is then carried out with this normal concentration. The duration $t_2$ of the surge feeding SD amounts for example to between 1 and 2 minutes and is considerably shorter than the stoppage $t_1$.

During the stoppage time $t_1$, the counter 32 counts upwards in steps in the sequence of the interval pulses, the count n developing in accordance with the curve 33 in FIG. 6 and asymptotically approaching the maximum count $n_{max}$ which is finally reached if the stoppage of the dishwashing machine is not interrupted beforehand. The maximum count $n_{max}$ corresponds to the maximum surge feeding time. The maximum count is reached when the stoppage time amounts to around 5 $\tau$ where $\tau$ is the consumption time constant of the enzyme. The counting rate of the counter 32 during downward counting is selected so that, for a maximum surge feeding time, the required enzyme concentration $C_o$ is re-established in the wash liquor. The counting rate R in 1/s amounts to:

$$R = \frac{n_{max}}{V_{max}}$$

where $V_{max}$ is the maximum surge feeding time.

Depending on the consumption rate of the enzyme, the maximum count is reached after a stoppage time of 0.5 to 3 hours.

In the above-described processes for the feed of detergent 2, 19 and enzyme-containing detergency booster 5, a low-alkali detergent based on phosphate or nitrilotriacetic acid or salts thereof (NTA) is used as the detergent in the described arrangements while an amylase-containing booster 5 is added to the dishwashing machine. In addition to or instead of amylase, however, the detergency booster may also contain lipase or protease. A detergency booster based on Thermamyl 300 L (NOVO) consisting of 0.55% by weight of amylase, 18.0% by weight of 1,2-propylene glycol, 72% by weight of water, 9.45% by weight of residual water and salts is preferably used. The detergent 2, 19 and/or detergency booster 5 may be introduced into at least one washing or feed tank of the dishwashing machine and/or into the final rinse pipe and/or the spray system of the dishwashing machine.

In processes with no maintenance or surge feedings, the enzyme-containing detergency booster is merely added at the same time or subsequently to the low-alkali detergent of the wash liquor during the regular operation of the dishwashing machine at typical detergent concentrations in the wash liquor of 0.5 to 8 g/l and/or during periodic thorough cleaning at an increased concentration of 3 to 15 g/l in the wash liquor. To this end, it is sufficient to equip an institutional dishwashing machine with two feed systems, one for the detergent and one for the booster. For example, these systems may assume the form of two feed pumps designed to operate in parallel with one another.

What is claimed is:

1. An institutional machine dishwashing process comprising:

contacting wash liquor having pH of 7 to 11 and article in institutional dishwashing machine;

detergent feeding to the wash liquor;

establishing detergent concentration of 0.5 to 15 g/l in the wash liquor during main wash cycle;

feeding to the wash liquor, independent of the detergent feeding, detergency booster comprising detersive enzyme;

establishing predetermined detersive enzyme concentration in the wash liquor during the main wash cycle, the detersive enzyme concentration decreasing after feeding, detergency booster;

determining according to an exponential function the amount of decrease in the detersive enzyme concentration; and refeeding to the wash liquor in a surge, independent of the detergent feeding, detergency booster containing the amount of detersive enzyme determined according to the exponential function;

wherein refeeding comprises:

generating pulses at regular time intervals and decreasing the pulse size with increasing time; so that the curve of time against cumulative pulse size approximates the exponential function; and calculating the amount of detergency booster for refeeding from the cumulative pulse size.

2. The process of claim 1, comprising generating pulses during the main wash cycle when detergent is not being fed.

3. The process of claim 1, comprising generating pulses during an interruption or stoppage phase.

4. The process of claim 1, wherein refeeding detergency booster, independent of detergent, comprises refeeding detergency booster, but not detergent, to the wash liquor during the main wash cycle.

5. The process of claim 1, wherein refeeding detergency booster, independent of detergent, comprises refeeding detergency booster, but not detergent, to the wash liquor during an interruption or stoppage phase.

6. The process of claim 1, wherein refeeding detergency booster, independent of detergent, comprises refeeding detergency booster, but not detergent, to the wash liquor after an interruption or stoppage phase.

7. The process of claim 1, wherein the detergent comprises phosphate or nitrilotriacetic acid or salt thereof.

8. The process of claim 1, wherein the detergency booster comprises 0.01 to 0.6% by weight of detersive enzyme.

9. The process of claim 8, wherein the detersive enzyme comprises amylase.

10. The process of claim 1, wherein the detersive enzyme comprises lipase, protease, amylase, or a combination thereof.

11. The process of claim 1, wherein the detersive enzyme comprises thermostable amylase.

12. The process of claim 1, comprising establishing detergency booster concentration of 0.05 to 2 g/l in the wash liquor during the main wash cycle.

13. The process of claim 1, further comprising rinsing the article, after maintaining contact, and removing and suppressing starch deposits on the article.

14. The process of claim 1, wherein the wash liquor pH is 9.1 to 10.8.

15. The process of claim 1, wherein the wash liquor detergent concentration is 0.5 to 8 g/l during the main wash cycle.

16. The process of claim 1, wherein the detergent concentration in the wash liquor is 3 to 15 g/l during the main wash cycle.

17. The process of claim 1, wherein the detergency booster comprises 10% to 25% by weight of propylene glycol.

18. The process of claim 1, comprising refeeding detergency booster after the enzyme concentration of the wash liquor falls by about 20% due to enzyme degradation during the main wash cycle.

* * * * *